US006057520A

United States Patent [19]

Goodwin-Johansson

[11] Patent Number: 6,057,520

[45] Date of Patent: May 2, 2000

[54] ARC RESISTANT HIGH VOLTAGE MICROMACHINED ELECTROSTATIC SWITCH

[75] Inventor: Scott Halden Goodwin-Johansson, Pittsboro, N.C.

[73] Assignee: MCNC, Research Triangle Park, N.C.

[21] Appl. No.: 09/345,300

[22] Filed: Jun. 30, 1999

[51] Int. Cl.[7] ..... H01H 57/00

[52] U.S. Cl. ..... 200/181; 200/512

[58] Field of Search ..... 200/181, 16, 512, 200/1 B

[56] References Cited

U.S. PATENT DOCUMENTS

| | | |
|---|---|---|
| Re. 33,568 | 4/1991 | Harnden, Jr. et al. . |
| Re. 33,577 | 4/1991 | Harnden, Jr. et al. . |
| Re. 33,587 | 5/1991 | Harnden, Jr. et al. . |
| Re. 33,618 | 6/1991 | Harnden, Jr. et al. . |
| Re. 33,691 | 9/1991 | Harnden, Jr. et al. . |

(List continued on next page.)

OTHER PUBLICATIONS

Surface–Micromachined Electrostatic Microrelay, I. Schiele et al., Sensors and Actuators A 66 (1998) pp. 345–354 No Date.

Active Joints for Microrobot Limbs, M. Elwenspoek et al., J. Micromech. Microeng. 2 (1992) pp. 221–223 No Date.

Deformable Grating Light Valves for High Resolution Displays, R. B. Apte et al., Solid–State Sensor and Actuator Workshop, Jun. 13–16, 1994, pp. 1–6.

Microwave Reflection Properties of a Rotating Corrugated Metallic Plate Used as a Reflection Modulator, G. E. Peckman et al., IEEE Transactions on Antennas and Propagation, vol. 36, No. 7, Jul., 1988, pp. 1000–1006.

Large Aperture Stark Modulated Retroreflector at 10.8 $\mu$m, M. B. Klein, J. Appl. Phys. 51(12), Dec. 1980, pp. 6101–6104.

A Large–Aperture Electro–Optic Diffraction Modulator, R. P. Bocker et al., J. Appl. Phys. 50(11), Nov. 1979, pp. 6691–6693.

Integrable Active Microvalve With Surface Micromachined Curled–Up Actuator, J. Haji–Babaer et al., Transducers 1997 International Conference on Solid–State Sensors and Actuators, Chicago, Jun. 16–19, 1997, pp. 833–836.

Electrostatic Curved Electrode Actuaturs, R. Legtenberg et al., IEEE Catalog No. 95CH35754, Jan. 29, Feb. 2, 1995, pp. 37–42.

Design and Development of Microswitches for Micro–Electro–Mechanical Relay Matrices, Thesis, M. W. Phillips, USAF, AFIT/GE/ENG/95J–02, 1995 No Month.

*Primary Examiner*—Michael L. Gellner
*Assistant Examiner*—Nhung Nguyen
*Attorney, Agent, or Firm*—Alston & Bird LLP

[57] ABSTRACT

A MEMS (Micro Electro Mechanical System) electrostatically operated device is provided that can switch high voltages while providing improved arcing tolerance. The MEMS device comprises a microelectronic substrate, a substrate electrode, first and second contact sets, an insulator, and a moveable composite. The moveable composite overlies the substrate and substrate electrode. In cross section, the moveable composite comprises an electrode layer and a biasing layer. In length, the moveable composite comprises a fixed portion attached to the underlying substrate, a medial portion, and a distal portion moveable with respect to the substrate electrode. Each contact set has at least one composite contact attached to the moveable composite, and preferably at least one substrate contact attached to the substrate. One of the contact sets is closer to the composite distal portion. The distal and/or medial portions of the moveable composite are biased in position when no electrostatic force is applied. Applying a voltage between the substrate electrode and moveable composite electrode creates an electrostatic force that attracts the moveable composite to the underlying substrate. The first and second contact sets are electrically connected when the distal portion of the moveable composite is attracted to the substrate. Once electrostatic force is removed, the moveable composite reassumes the biased position such that the first and second contact sets are disconnected in a sequence to minimize arcing. Various embodiments and methods of using the electrostatic MEMS device are provided.

43 Claims, 5 Drawing Sheets

U.S. PATENT DOCUMENTS 2,851,618 9/1958 Krawinkel .
2,927,255 3/1960 Diesel .
2,942,077 6/1960 Diesel .
3,772,537 11/1973 Clifford .
3,917,196 11/1975 Pond et al. .
4,025,193 5/1977 Pond et al. .
4,209,689 6/1980 Linford et al. .
4,361,911 11/1982 Buser et al. .
4,403,166 9/1983 Tanaka et al. .
4,447,723 5/1984 Neumann .
4,473,859 9/1984 Stone et al. .
4,480,162 10/1984 Greenwood .
4,517,569 5/1985 Gerharz .
4,553,061 11/1985 Germano .
4,581,624 4/1986 O'Connor .
4,595,855 6/1986 Farrall .
4,620,123 10/1986 Farrall et al. .
4,620,124 10/1986 Farrall et al. .
4,622,484 11/1986 Okihara et al. .
4,626,698 12/1986 Harnden, Jr. et al. .
4,658,154 4/1987 Harnden, Jr. et al. .
4,727,593 2/1988 Goldstein .
4,731,879 3/1988 Sepp et al. .
4,736,202 4/1988 Simpson et al. .
4,747,670 5/1988 Devio et al. .
4,777,660 10/1988 Gould et al. .
4,794,370 12/1988 Simpson et al. .
4,811,246 3/1989 Fitzgerald, Jr. et al. .
4,819,126 4/1989 Kornrumpf et al. .
4,826,131 5/1989 Mikkor .
4,857,757 8/1989 Sato et al. .
4,893,048 1/1990 Farrall .
4,916,349 4/1990 Kornrumpf .
4,983,021 1/1991 Fergason .
5,051,643 9/1991 Dworsky et al. .
5,065,978 11/1991 Albarda et al. .
5,093,600 3/1992 Kohl .
5,162,691 11/1992 Mariani et al. .
5,177,331 1/1993 Rich et al. ..... 200/61.45 R
5,233,459 8/1993 Bozler et al. .
5,243,861 9/1993 Kloeck et al. .
5,258,591 11/1993 Buck .
5,261,747 11/1993 Deacutis et al. .
5,268,696 12/1993 Buck et al. .
5,274,379 12/1993 Carbonneau et al. .
5,278,368 1/1994 Kasano et al. .
5,311,360 5/1994 Bloom et al. .
5,355,241 10/1994 Kelley .
5,367,136 11/1994 Buck ..... 200/600
5,367,584 11/1994 Ghezzo et al. .
5,438,449 8/1995 Chabot et al. .
5,463,233 10/1995 Norling .
5,467,068 11/1995 Field et al. .
5,479,042 12/1995 James et al. .
5,499,541 3/1996 Hopf et al. .
5,544,001 8/1996 Ichiya et al. .
5,552,925 9/1996 Worley .
5,578,976 11/1996 Yao .
5,594,292 1/1997 Takeuchi et al. .
5,619,061 4/1997 Goldsmith et al. .
5,620,933 4/1997 James et al. .
5,627,396 5/1997 James et al. .
5,629,565 5/1997 Schlaak et al. .
5,638,946 6/1997 Zavracky ..... 200/181
5,658,698 8/1997 Yagi et al. .
5,659,195 8/1997 Kaiser et al. .
5,661,592 8/1997 Bornstein et al. .
5,666,258 9/1997 Gevatter et al. .
5,673,785 10/1997 Schlaak et al. .
5,677,823 10/1997 Smith .
5,723,894 3/1998 Ueno et al. .
5,726,480 3/1998 Pister .
5,796,152 8/1998 Carr et al. .
5,818,683 10/1998 Fujii .

ARC RESISTANT HIGH VOLTAGE MICROMACHINED ELECTROSTATIC SWITCH

FIELD OF THE INVENTION

The present invention relates to microelectromechanical switch and relay structures, and more particularly to electrostatically activated high voltage switch and relay structures that are resistant to arcing.

BACKGROUND OF THE INVENTION

Advances in thin film technology have enabled the development of sophisticated integrated circuits. This advanced semiconductor technology has also been leveraged to create MEMS (Micro Electro Mechanical System) structures. MEMS structures are typically capable of motion or applying force. Many different varieties of MEMS devices have been created, o including microsensors, microgears, micromotors, and other microengineered devices. MEMS devices are being developed for a wide variety of applications because they provide the advantages of low cost, high reliability and extremely small size.

Design freedom afforded to engineers of MEMS devices has led to the development of various techniques and structures for providing the force necessary to cause the desired motion within microstructures. For example, microcantilevers have been used to apply rotational mechanical force to rotate micromachined springs and gears. Electromagnetic fields have been used to drive micromotors. Piezoelectric forces have also been successfully been used to controllably move micromachined structures. Controlled thermal expansion of actuators or other MEMS components has been used to create forces for driving microdevices. One such device is found in U.S. U.S. Pat. No. 5,475,318, which leverages thermal expansion to move a microdevice. A micro cantilever is constructed from materials having different thermal coefficients of expansion. When heated, the bimorph layers arch differently, causing the micro cantilever to move accordingly. A similar mechanism is used to activate a micromachined thermal switch as described in U.S. U.S. Pat. No. 5,463,233.

Electrostatic forces have also seen used to move structures. Traditional electrostatic devices were constructed from laminated films cut from plastic or mylar materials. A flexible electrode was attached to the film, and another electrode was affixed to a base structure. Electrically energizing the respective electrodes created an electrostatic force attracting the electrodes to each other or repelling them from each other. A representative example of these devices is found in U.S. U.S. Pat. No. 4,266,399. These devices work well for typical motive applications, but these devices cannot be constructed in dimensions suitable for miniaturized integrated circuits, biomedical applications, or MEMS structures.

Micromachined MEMS electrostatic devices have been created which use electrostatic forces to operate electrical switches and relays. Various MEMS relays and switches have been developed which use relatively rigid cantilever members separated from the underlying substrate in order to make and break electrical connections. Typically, contacts at the free end of the cantilever within these MEMS devices move as the cantilever deflects, so that electrical connections may be selectively established. As such, when the contacts are connected in these MEMS devices, most of the cantilever remains separated from the underlying substrate. For instance, U.S. Pat. Nos. 5,367,136, 5,258,591, and 5,268,696 to Buck, et al., U.S. Pat. No. 5,544,001 to Ichiya, et al., and U.S. Pat. No. 5,278,368 to Kasano, et al. are representative of this class of microengineered switch and relay devices.

Another class of micromachined MEMS switch and relay devices include curved cantilever-like members for establishing electrical connections. For instance, U.S. Pat. Nos. 5,629,565 and 5,673,785 to Schlaak, et al., describe a microcantilever that curls as it separates from the fixed end of the cantilever and then generally straightens. The electrical contact is disposed at the generally straight free end of the microcantilever. When electrostatically attracted to a substrate electrode, the Schlaak devices conform substantially to the substrate surface except where the respective electrical contacts interconnect. In addition, a technical publication by Ignaz Schiele, et al., titled *Surface-Micromachined Electrostatic Microrelay* also describes micromachined electrostatic relays having a curled cantilever member. The Schiele cantilever initially extends parallel to the underlying substrate as it separates from the fixed end before curling away from the substrate. While the cantilever member having a contact comprises a multilayer composite, flexible polymer films are not used therein. As such, the Schiele devices do not describe having the cantilever member conform substantially to the underlying substrate in response to electrostatic actuation thereof.

Because of their extremely small size, MEMS electrostatic switches and relays are used advantageously in various applications. Electrostatic forces due to the electric field between electrical charges can generate relatively large forces given the small electrode separations inherent in MEMS devices. However, problems can arise when these miniaturized devices are used in high voltage applications. Since MEMS devices include structures separated by micron scale dimensions, high voltages can create electrical arcing and other related problems. In effect, the close proximity of contacts within MEMS relays and switches multiplies the severity of these high voltage problems. In addition, since electrical contacts within MEMS relays and switches are so small, high voltage arcing tends to pit and erode the contacts. Because it is difficult to resolve high voltage problems within MEMS devices, conventional devices try to avoid the problem by using lower voltages in operation. As such, traditional MEMS electrostatic switch and relay devices are not well suited for high voltage switching applications.

It would be advantageous to provide electrostatic MEMS switch and relay devices that were designed to operate reliably with high voltages. In addition, it would be advantageous to provide MEMS electrostatic switching devices that were adapted to address at least some of the arcing and high voltage operation problems. There is still a need to develop improved MEMS devices for reliably switching high voltages while leveraging electrostatic forces therein. Existing applications for MEMS electrostatic devices could be better served. In addition, advantageous new devices and applications could be created by leveraging the electrostatic forces in new MEMS structures.

SUMMARY OF THE INVENTION

It is an object of the present invention to provide MEMS electrostatic switches and relays that are designed to switch relatively high voltages.

In addition, it is an object of the present invention to provide MEMS electrostatic switches and relays actuators that are designed to overcome at least some of the arcing and other problems related to high voltage.

Further, it is an object of the present invention to provide improved MEMS electrostatic switches and relays.

The present invention provides improved MEMS electrostatic devices that can operate as high voltage, arcing resistant switches or relays. In addition, methods for using a MEMS electrostatic device according to the present invention are provided. The present invention solves at least some of the above noted problems, while satisfying at least some of the listed objectives.

A MEMS device driven by electrostatic forces according to the present invention comprises a microelectronic substrate, a substrate electrode, a moveable composite, first and second contact sets, and an insulator. The microelectronic substrate defines a planar surface upon which the MEMS device is constructed. The substrate electrode forms a layer on the surface of the microelectronic substrate. The moveable composite overlies the substrate electrode. In cross section, the moveable composite comprises an electrode layer and a biasing layer. The moveable composite across its length comprises a fixed portion attached to the underlying substrate, and a distal portion moveable with respect to the substrate electrode. In addition, the MEMS device includes first and second contact sets, each contact set having at least one composite contact attached to the moveable composite. Further, one of the two contact sets is closer to the distal portion of the moveable composite than the other contact set. The insulator electrically isolates and separates the substrate electrode from the electrode layer of the moveable composite. Applying a voltage differential between the substrate electrode and the electrode layer of the moveable composite creates an electrostatic force that moves the distal portion and alters the separation from the underlying planar surface. As such, the first and second contact sets are electrically connected when the distal portion of the moveable composite is attracted to the underlying microelectronic substrate.

One group of embodiments describe various implementations of the first and second contact sets. In some embodiments, the first contact set or second contact set are relatively closer to the distal portion of the moveable composite as compared to the other contact set. Further, the first contact set may be arranged to sequentially disconnect before the second contact set as the moveable distal portion separates from the underlying substrate. In one embodiment, the second contact set may alternatively comprise an array of at least two contact sets, or a linear array of at least two contact sets. Further, the second contact set can be arranged to electrically disconnect all contacts therein generally simultaneously when the distal portion of the moveable composite separates from the substrate. Other embodiments include a first contact set comprising a single contact set, or provide a first contact set electrically connected in parallel with the second contact set. In one embodiment, the second contact set has a greater electrical resistance than the first contact set. Further, one embodiment provides each contact set with at least one substrate contact attached to the microelectronic substrate. One embodiment provides an electrostatic MEMS device wherein the first and second contact sets share at least one common contact, which may or may not be attached to the moveable composite. Further embodiments provide contacts within the second contact set connected electrically in series or alternatively in parallel.

An additional group of embodiments describes various alternative implementations of the moveable composite and the layers therein. One embodiment of the MEMS electrostatic device according to the present invention forms the electrode layer and biasing layer of the moveable composite from one or more generally flexible materials. Layers comprising the composite can be selected such that the moveable composite substantially conforms to the surface of the microelectronic substrate when the distal portion of the moveable composite is attracted to the microelectronic substrate. In addition, layers comprising the moveable composite can be selected such that the distal portion can be positionally biased with respect to the microelectronic substrate.

In one embodiment, a biasing layer is included that urges the distal portion of the moveable composite to curl generally away from the underlying substrate. Other embodiments provide different thermal coefficients of expansion causing the moveable composite to curl. Different coefficients may be used within the moveable composite, such as between the biasing layer and electrode layer, or instead between one or more polymer films used as the biasing layer and the electrode layer. One embodiment provides a distal portion of the moveable composite that curls out of the plane defined by the substrate surface in the absence of electrostatic force.

The present invention also provides an electrostatic MEMS device as described above, further including a source of electrical energy and a switchable device electrically connected to the first and second contact sets. In addition, the present invention provides a method of using the aforementioned MEMS device, comprising the steps of selectively generating an electrostatic force between the substrate electrode and electrode layer of the moveable composite, moving the moveable composite toward the microelectronic substrate, and electrically connecting the contacts of the first and second contact sets. In addition, one embodiment of the method comprises the steps of discontinuing the electrostatic force, separating the moveable composite from the underlying microelectronic substrate, and sequentially disconnecting the contacts associated with the first and second contact sets. Further embodiments provide alternative representations and enhancements of the aforementioned method steps.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
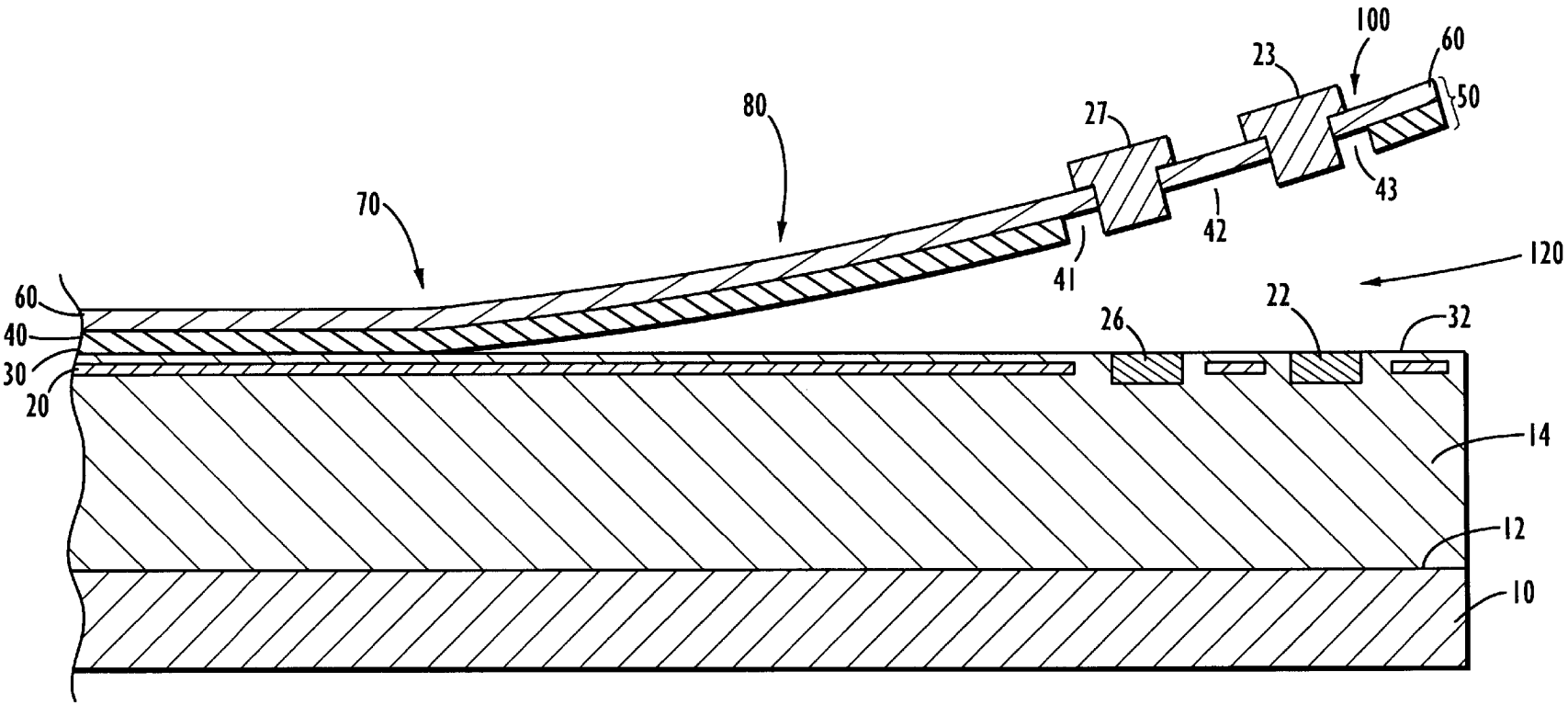
FIG. 1 is a cross-sectional view of one embodiment of the present invention taken along the line 1—1 of FIG. 2.

Referring to FIG. 1, the present invention provides a MEMS device driven by electrostatic forces that can switch high voltages while overcoming at least some arcing and related problems. In a first embodiment, an electrostatic MEMS device comprises in layers, a microelectronic substrate 10, a substrate electrode 20, a substrate insulator 30, and a moveable composite 50. The moveable composite is generally planar and overlies the microelectronic substrate and substrate electrode. The layers are arranged and shown vertically, while the portions are disposed horizontally along the moveable composite. In cross section, the moveable composite 50 comprises multiple layers including at least one electrode layer 40 and at least one biasing layer 60. Along its length, the moveable composite has a fixed portion 70, a medial portion 80, and a distal portion 100. The fixed portion is substantially affixed to the underlying microelectronic substrate or intermediate layers. The medial portion and distal portion are released from the underlying substrate, and in operation preferably both portions are moveable with respect to the underlying substrate and substrate electrode. The medial portion extends from the fixed portion and is biased or held in position without the application of electrostatic force. The distal portion extends from the medial portion, and is also biased or held in position without the application of electrostatic force. However, in some embodiments, the medial portion may be held in position whether or not electrostatic force is applied, such that only the distal portion is free to move in operation. An air gap 120 is defined between the medial portion, distal portion, and the planar surface of the underlying microelectronic substrate. By predefining the shape of the air gap, recently developed MEMS electrostatic devices can operate with lower and less erratic operating voltages. For example, U.S. patent application Ser. No. 09/320,891, entitled "Micromachined Electrostatic Actuator With Air Gap", filed on May 27, 1999, in the name of inventor Goodwin-Johansson, and assigned to MCNC, the assignee of the present invention, describing these improved electrostatic devices, is incorporated by reference herein.

The electrostatic MEMS device, including the moveable composite and underlying substrate layers, is constructed using known integrated circuit materials and microengineering techniques. Those skilled in the art will understand that different materials, various numbers of layers, and numerous arrangements of layers may also be used to form the underlying substrate layers. Although the MEMS device illustrated in the Figures will be used as an example to describe manufacturing details, this discussion applies equally to all MEMS devices provided by the present invention unless otherwise noted. Referring to FIG. 1, a microelectronic substrate 10 defines a planar surface 12 upon which the electrostatic MEMS device is constructed. Preferably the microelectronic substrate comprises a silicon wafer, although any suitable substrate material having a planar surface can be used. Other semiconductors, glass, plastics, or other suitable materials may serve as the substrate. An insulating layer 14 overlies the planar surface of the microelectronic substrate and provides electrical isolation. The insulating layer preferably comprises a non-oxidation based insulator or polymer, such as polyimide or nitride. In this case, oxide based insulators cannot be used if certain acids are used in processing to remove the release layer. Other insulators, even oxide based insulators, may be used if release layer materials and compatible acids or etchants are used for removing the release layer. For instance, silicon dioxide could be used for the insulating layers if etchants not containing hydrofluoric acid are used. The insulating layer is preferably formed by depositing a suitable material on the planar surface of the microelectronic substrate. A substrate electrode 20 is disposed as a generally planar layer affixed to at least a portion of the surface of the underlying insulating layer 14. The substrate electrode preferably comprises a gold layer deposited on the top surface of the insulating layer. If the substrate electrode is formed from a layer of gold, optionally a thin layer of chromium may be deposited onto the substrate electrode layer to allow better adhesion to the insulating layer and any adjacent materials. Alternatively, other metallic or conductive materials may be used so long as they are not eroded by release layer processing operations.

Preferably, a second insulating layer 30 is deposited on the substrate electrode 20 to electrically isolate the substrate electrode and prevent electrical shorting. In particular, the insulating layer separates the substrate electrode from the electrode layer of the moveable composite. Further, the second insulating layer provides a dielectric layer of predetermined thickness between the substrate electrode 20 and the moveable composite, including the moveable electrode 40. The second insulating layer 30 preferably comprises polyimide, although other dielectric insulators or polymers tolerant of release layer processing may also be used. The second insulating layer 30 has a generally planar surface 32.

Figure 7:
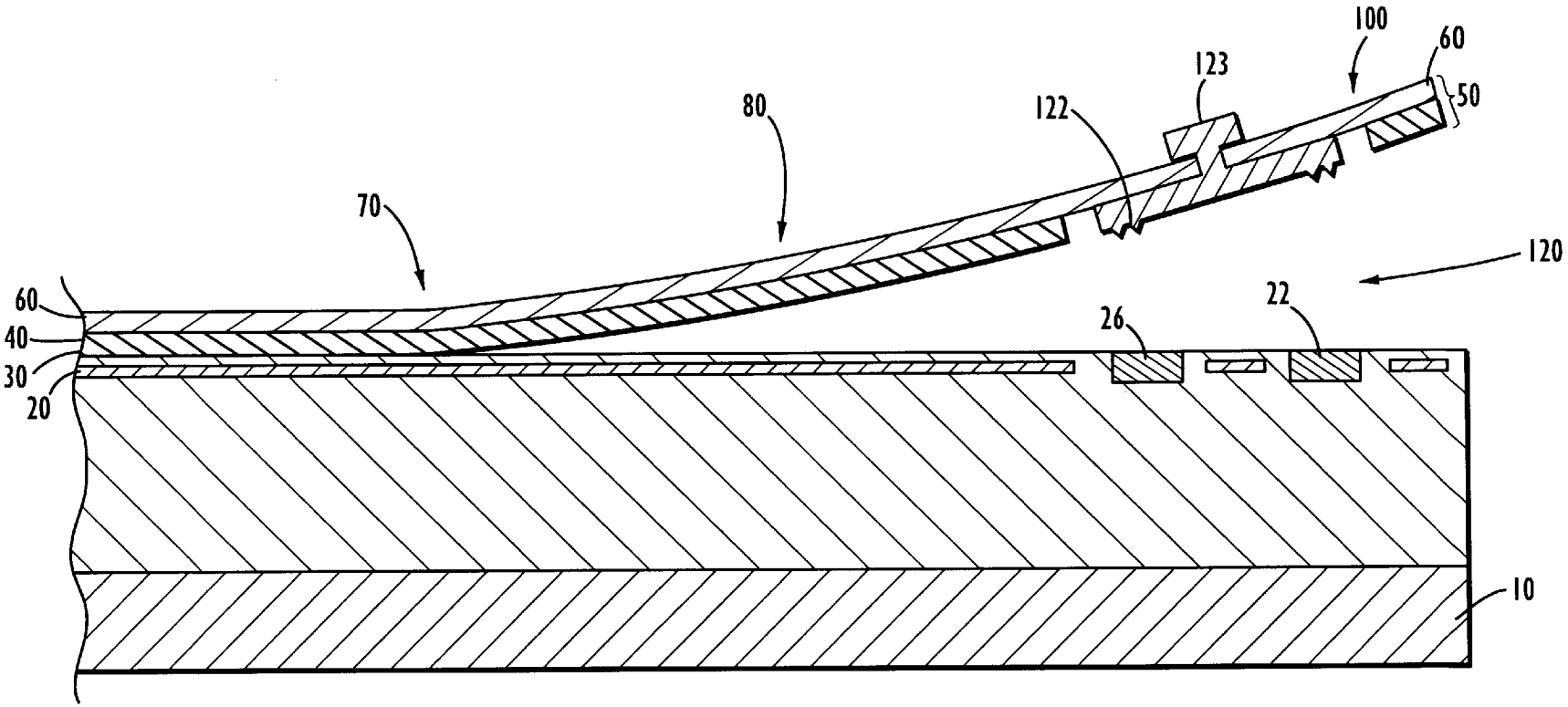
FIG. 7 is a cross sectional view of an alternate embodiment of the present invention.

A release layer, not shown, is first deposited on the planar surface 32 in the area underneath the medial and distal portions of the overlying moveable composite, occupying the space shown as the air gap 120. The release layer is only applied to areas below moveable composite portions not being affixed to the underlying planar surface. Preferably, the release layer comprises an oxide or other suitable material that may be etched away when acid is applied thereto. After the overlying layers have been deposited, the release layer may be removed through standard microengineering acidic etching techniques, such as a hydrofluoric acid etch. When the release layer has been removed, the medial and distal portions of moveable composite 50 are separated from the underlying planar surface 32, creating the air gap 120 therebetween. The shape of the air gap is determined according to the bias provided to the distal portion and/or medial portion of the moveable composite when no electrostatic force is applied. In one embodiment, the air gap decreases and gradually ends where the fixed portion of the moveable composite contacts the underlying substrate, as shown in FIG. 7. In another embodiment, shown in FIG. 8, the air gap decreases, has a generally constant width, and then ends abruptly where the fixed portion contacts the underlying substrate. The medial portion in this Figure has a generally cantilevered part overlying the substrate proximate the fixed portion.

The layers of the moveable composite 50 generally overlie planar surface 32. Known integrated circuit manufacturing processes are used to construct the layers comprising moveable composite 50. At a minimum, two layers comprise the moveable composite 50, one layer of moveable electrode 40 and one layer of polymer film 60 disposed on either side of the moveable electrode. The layer of polymer film preferably comprises the biasing layer used to hold the moveable composite in a given position with respect to the underlying planar surface, absent electrostatic forces. Preferably, at least one of the layers comprising the moveable composite is formed from a flexible material, for instance flexible polymers and/or flexible conductors may be used. Optionally, a first layer of polymer film can be applied overlying at least part of the area defined by the release layer and the exposed planar surface 32, to insulate the moveable electrode 40 layer from the underlying substrate. For instance, a layer of polymer film, such as polymer film 60 shown as the top layer of the moveable composite 50, can be used as the first layer of polymer film. While polyimide is preferred for the polymer film layer, many other flexible polymers suitable for release layer fabrication processes may be used.

Moveable electrode 40, preferably comprising a layer of flexible conductor material, is deposited overlying the planar surface 32. The moveable electrode may be deposited directly upon the planar surface or over an optional first layer of polymer film, as needed. The moveable electrode 40 preferably comprises gold, although other acid tolerant yet flexible conductors, such as conductive polymer film, may be used. The surface area and/or configuration of moveable electrode 40 can be varied as required to create the desired electrostatic forces to operate the high voltage MEMS device. Optionally, a second layer of polymer film 60 is applied overlying at least part of the moveable electrode layer. As before, a flexible polymer such as polyimide is preferred for the second polymer film layer. If gold is used to form the moveable electrode, a thin layer of chromium may be deposited onto the moveable electrode layer to allow better adhesion of the gold layer to the adjacent materials, such as to one or more layers of polymer film.

The number of layers, thickness of layers, arrangement of layers, and choice of materials used in the moveable composite may be selected to bias the moveable composite as required. In particular, the distal portion and/or the medial portion can be biased as they extend from the fixed portion. The biased position of the medial and distal portions can be customized individually or collectively to provide a desired separation from the underlying planar surface and the substrate electrode. The distal and medial portions can be biased to remain parallel to the underlying planar surface. Alternatively, the distal and medial portions can be biased to alter the separation from the underlying planar surface by curling toward or curling away from the underlying planar surface. Preferably, the distal portion and optionally the medial portion are biased to curl away from the underlying substrate and alter the separation therefrom. Those skilled in the art will appreciate that more than one polymer film layer may be used, and that the films may be disposed on either side or both sides of the moveable electrode.

At least one of the layers comprising the moveable composite can function as a composite biasing layer used to bias or urge the moveable composite to curl as required. Preferably, the medial portion 80 and distal portion 100 are biased to curl away from the underlying surface 32, after the release layer has been removed. Providing differential thermal coefficients of expansion between the layers comprising the moveable composite can create bias. Assuming an increase in temperature, the moveable composite will curl toward the layer having the lower thermal coefficient of expansion because the layers accordingly expand at different rates. As such, the moveable composite having two layers with different thermal coefficients of expansion will curl toward the layer having a lower thermal coefficient of expansion as the temperature rises. In addition, two polymer film layers having different thermal coefficients of expansion can be used in tandem with an electrode layer to bias the moveable composite as necessary.

Of course, other techniques may be used to curl the flexible composite. For example, different deposition process steps can be used to create intrinsic stresses so as to curl the layers comprising the flexible composite. Further, the flexible composite can be curled by creating intrinsic mechanical stresses in the layers included therein. In addition, sequential temperature changes can be used to curl the flexible composite. For instance, the polymer film can be deposited as a liquid and then cured by elevated temperatures so that it forms a solid polymer layer. Preferably, a polymer having a higher thermal coefficient of expansion than the electrode layer can be used. Next, the polymer layer and electrode layer are cooled, creating stresses due to differences in the thermal coefficients of expansion. The flexible composite curls because the polymer layer shrinks faster than the electrode layer.

Further, the relative thickness of the layers comprising the moveable composite and the order in which the layers are arranged can be selected to create bias. In addition, two or more polymer films of different thickness can be used on either side of the electrode layer for biasing purposes. For example, the thickness of the moveable electrode layer can also be selected to provide bias. As such, the medial portion and distal portion can be positionally biased and urged to curl with respect to the microelectronic substrate and substrate electrode. In one embodiment, the distal portion of the moveable composite curls out of the plane defined by the upper surface of the moveable composite when no electrostatic force is created between the substrate electrode and the composite electrode layer. Further, the medial portion, the distal portion, or both, can be biased to curl with any selected radius of curvature along the span of the portion, such as a variable or constant radius of curvature.

The MEMS device is further adapted to function as an electrostatically operated high voltage switch or relay that is arc resistant. First and second contact sets are provided in the MEMS device, each contact set comprising one or more pairs of mating contacts. For the example shown in FIG. 1, contact set 22 and 23 comprise one contact pair, while contact set 26 and 27 comprise another contact pair. Each contact set has at least one composite contact attached to the moveable composite, i.e., composite contacts 23 and 27, and at least one substrate contact attached to the substrate, i.e., substrate contacts 22 and 26, arranged to mate with the corresponding composite contact to close an electrical circuit.

One of the contact sets, i.e., first contact set 22, 23 is disposed closer to the distal portion 100 of the moveable composite than the other contact set 26, 27, as shown in FIG. 1. In a preferred embodiment, the first contact set is more proximate the distal portion of the moveable composite, while the second contact set is more proximate the fixed portion of the moveable composite. Accordingly, the first contact set is the contact set that is electrically connected last in time as the moveable composite is attracted to and rests upon planar surface 32 of the underlying substrate, and is electrically disconnected first in time as the moveable composite curls up from the planar surface and reassumes the biased position shown in FIG. 1.

Figure 2:
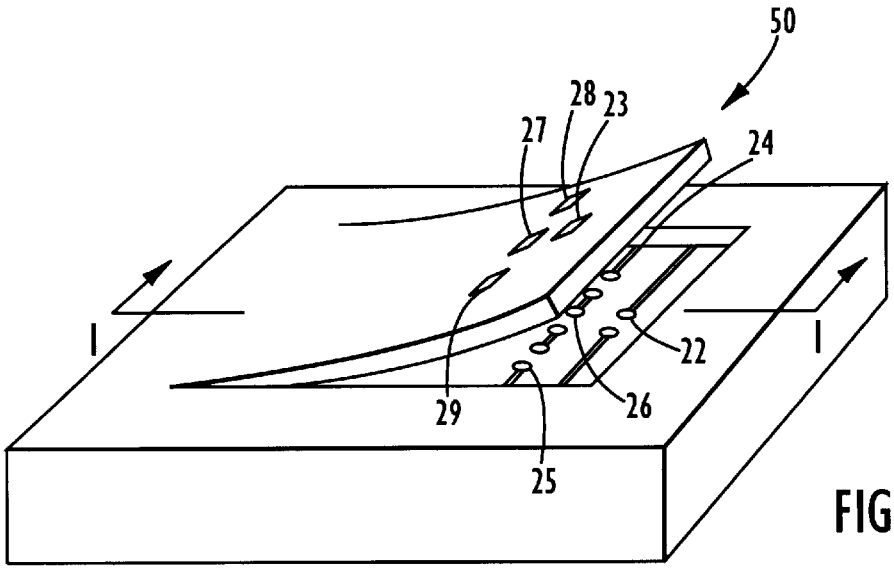
FIG. 2 is a perspective view of one embodiment according the present invention.
Figure 3:
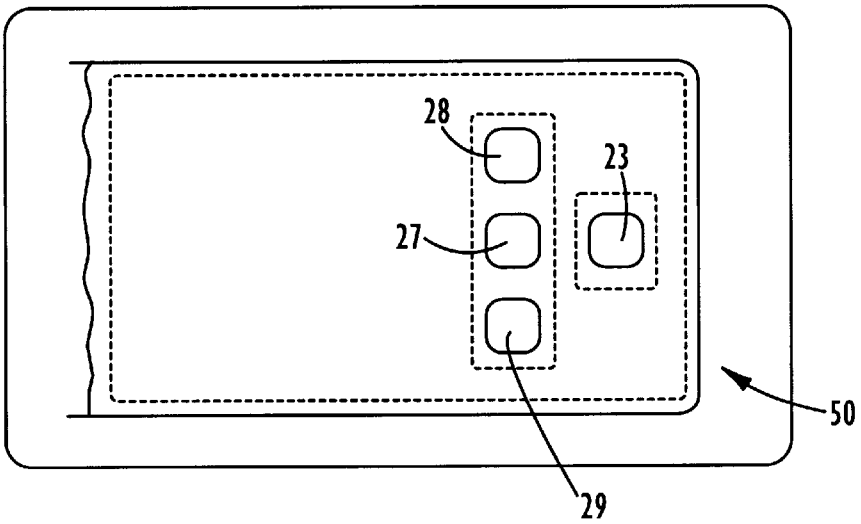
FIG. 3 is a top plan view of one embodiment according to the present invention.

In one embodiment the second contact set comprises an array of at least two contact sets. As shown in FIGS. 2 and 3, multiple contacts can be provided within a contact set. Contacts 27, 28, and 29 are adapted to connect with contacts 26, 24, and 25, respectively, when the moveable composite is attracted to and contacts the substrate surface. Optionally, the second contact set can comprise one of several different arrays of at least two contact sets. In addition, the second contact set can be arranged to electrically disconnect all contacts within the contact set generally simultaneously when the distal portion of the moveable composite separates from the substrate surface. The arrangement shown in FIG. 2 is the preferred embodiment, wherein groups of two substrate contacts and two composite contacts are interconnected such that the composite contacts act as shorting bars. Groups of contacts are combined in series and parallel to connect the contacts relatively sequentially or relatively simultaneously as required. Of course, contacts used as shorting bars can be electrically isolated from each other or electrically connected together as necessary to serve a particular application. The contact pairs as shown in FIG. 1 require making wiring interconnections to each composite contact if an adjacent composite contact is not available to provide a return path for electrical current.

Figure 4:
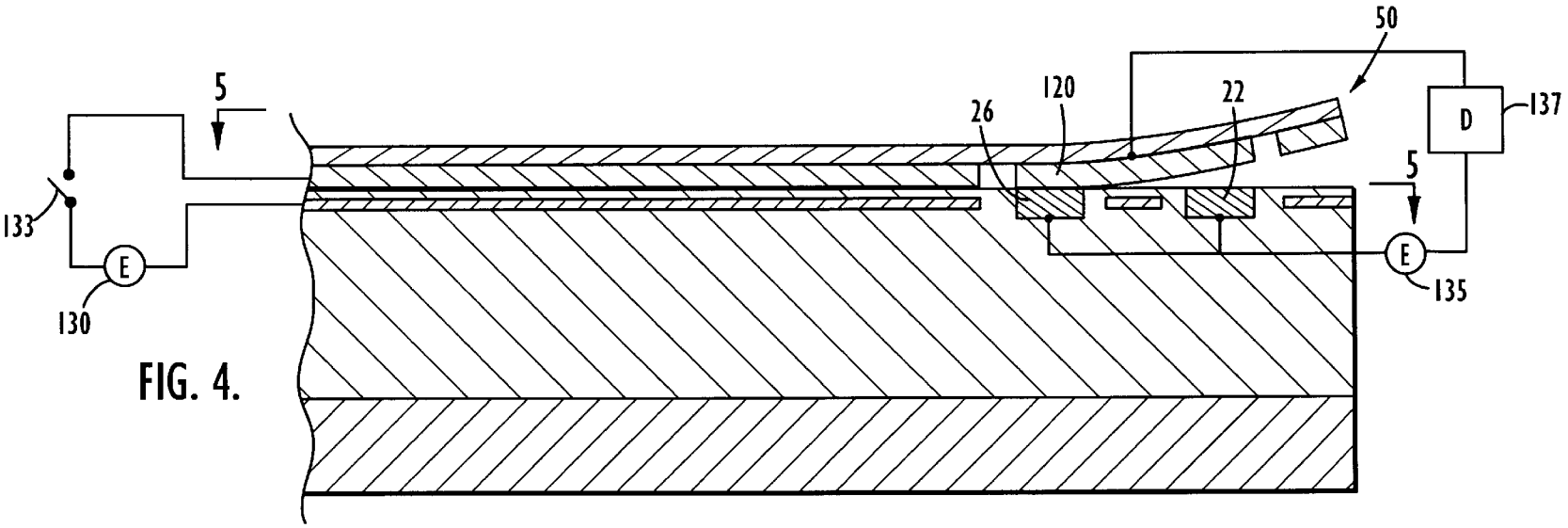
FIG. 4 is a cross-sectional view of an alternate embodiment of the present invention taken along the line 4—4 of FIG. 5.
Figure 6:
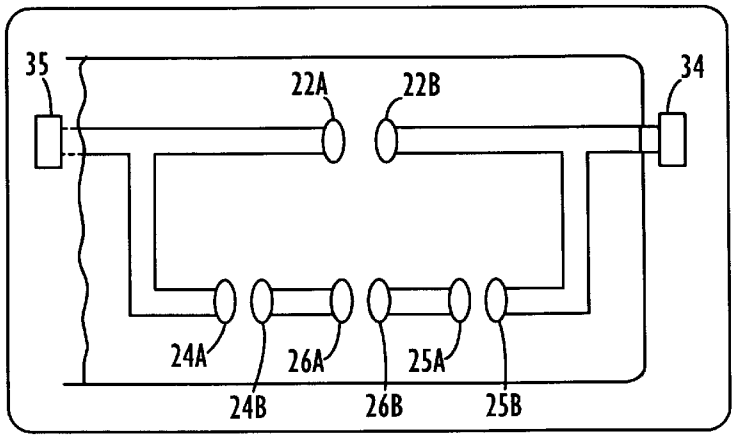
FIG. 6 is a top plan view of the substrate contacts shown in FIG. 2.
Figure 5:
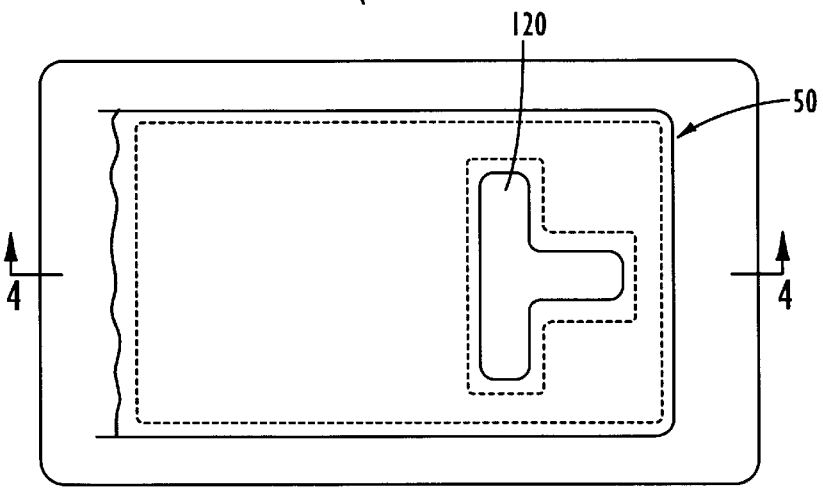
FIG. 5 is a top plan view of an alternate embodiment of the present invention.

Other alternative embodiments provide that contacts within the second contact set can be connected in series, in parallel, or both. In one embodiment, the first contact set comprises a single contact pair. Another advantageous embodiment provides the first contact set electrically connected in parallel with the second contact set, as shown in FIGS. 4–6. The multiple contacts of the second contact set may have higher electrical resistance, but when connected in parallel with the first contact set having a lower resistance, the effective "on" resistance of the parallel first and second contact sets is reduced when the moveable composite is attracted to and contacts the underlying substrate. Further, in one embodiment at least one of the first and second contact sets comprises a pair of contacts attached to the substrate. The contact sets further include a single large contact or electrically connected contacts attached to the moveable composite, such that the pair of contacts attached to the substrate can be electrically connected by the moveable composite contact. An example is shown in FIGS. 4 to 8 wherein a single contact (124 in FIGS. 4–5 and 122 in FIGS. 7–8) disposed on the moveable composite can serve as a shorting contact bar for interconnecting two or more substrate contacts. For instance, the T-shaped composite contact 124 in FIG. 5 interconnects substrate contacts 22 and 26, or an array of substrate contacts as shown in FIG. 2.

As noted, contacts comprising the first and second sets may be disposed on the moveable composite, the substrate, or both. Within a contact set, each substrate contact is preferably formed from a metallization layer, such as gold. Alternatively, if gold contacts are used a thin layer of chromium may be deposited onto the gold contacts to allow better adhesion of the gold layer to the adjacent materials. However, other metallic or conductive materials can be used so long as they are not eroded by processing used to remove the release layer. Preferably, at least one of the contact sets is electrically isolated and insulated from the substrate electrode 20 and any other substrate contacts, such that arcing and other high voltage problems are minimized. For instance, insulating layer 14 is provided to surround and insulate substrate contacts 22 and 26 as shown in FIG. 1. While an insulating layer 14 is preferred, air or other insulators can be used. In addition, the substrate electrode preferably surrounds at least part of the insulating gap around each substrate contact, such that the moveable composite can be electrostatically attracted over, and firmly contact the entire surface area of the substrate contact. When a contact set includes a composite contact, preferably each composite contact is disposed within the moveable electrode 40 layer and attached to the moveable composite. One or more composite contacts are formed from the moveable composite electrode layer, as shown in FIG. 1. Insulating gaps, such as 41, 42, and 43, serve to electrically isolate the composite contacts from the moveable electrode. While the insulating gaps are preferably filled with air, many other suitable insulators can be used. Further, the layer of polymer film 60 serves as an insulator. Similarly, at least one of the composite contacts within a contact set is electrically isolated from the substrate electrode 20. One or more insulators can be used in combination to electrically insulate the composite contact(s) accordingly. For instance, an insulating layer 30, a layer of polymer film 60, or both can be selectively applied as needed to electrically isolate the moveable composite and one or more composite contacts from the underlying substrate electrode 20.

Figure 8:
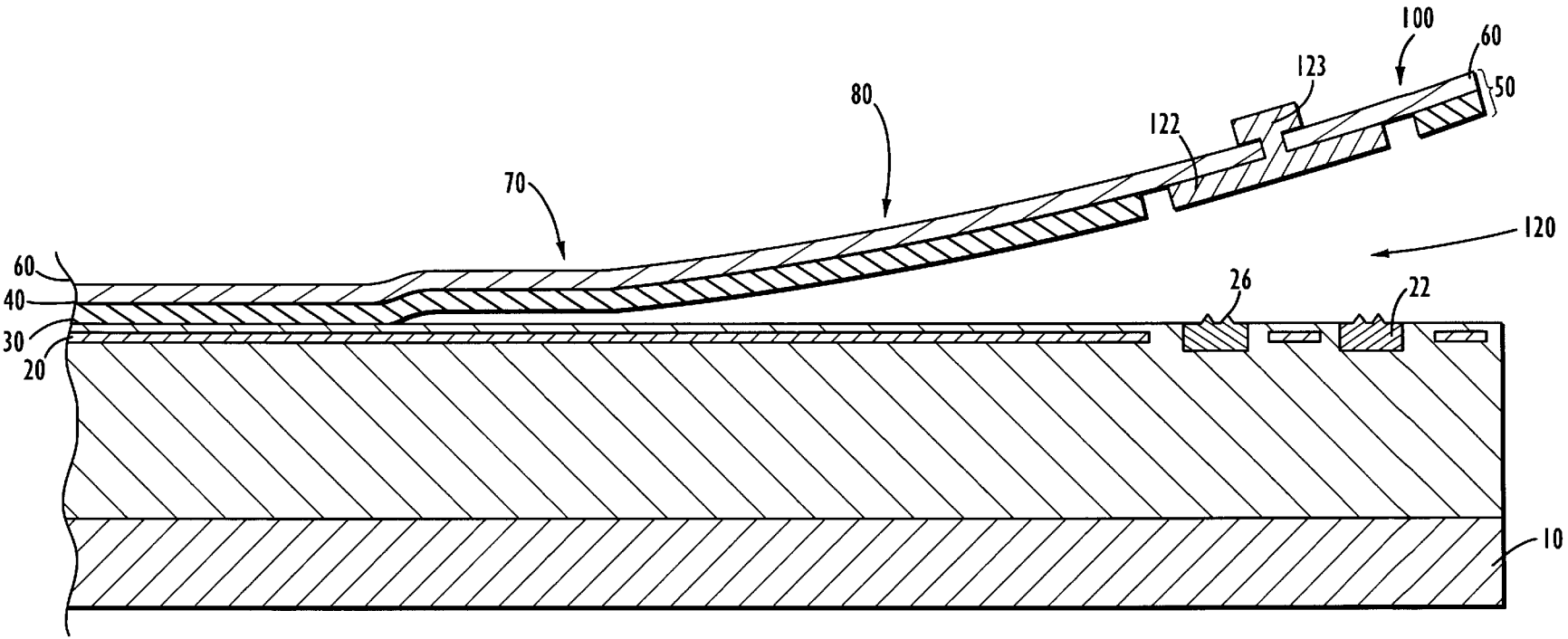
FIG. 8 is a cross sectional view of an alternate embodiment of the present invention.

Optionally, a composite contact can be adapted to extend through polymer film layer 60. As shown in FIG. 1, at least a portion of the composite contacts 23 and 27 protrudes above the upper polymer film layer so as to provide one or more electrical connections. As shown in FIG. 5, a single composite shorting bar 124 can protrude through the polymer film layer to provide an electrical connection between contact sets while also functioning as a component of each contact set. As shown in FIGS. 7 and 8, a single composite shorting bar 122 can protrude through the polymer film layer to provide an electrical connection 123. Metal lines may be deposited for interconnection.

The relative placement of substrate and composite contact sets can be varied as required for different switch or relay applications. As shown in FIG. 1, two or more mating contacts sets can be disposed along the length (from fixed to distal) of the moveable composite, such that some contact sets are mated before others as the composite is attracted to the substrate. For example, referring to FIG. 1, substrate contact 26 will mate with its composite contact before substrate contact 22 as the moveable composite is attracted to the underlying substrate. However, two or more contact sets can be disposed along the width of the moveable composite, such that two or more contacts within a set are mated at generally the same time. As shown in FIG. 2, for instance, substrate contacts 24, 25 and 26 will mate with their composite contacts generally simultaneously, before substrate contact 22, as the composite is attracted to the substrate. Further, as FIG. 3 shows, contact sets within the plurality can be disposed to mate both in parallel and in series as the moveable composite is attracted thereto.

Some embodiments of the MEMS device according to the present invention further comprise a source of electrical energy and an optional switching device. See the example in FIG. 4. The source of electrical energy can be any voltage source, current source, or electrical storage device, such as a battery, charged capacitor, energized inductor, or the like. The switching device can be any electrical switch or other semiconductor device used for selectively making and breaking an electrical connection. In one embodiment, a source of electrical energy 130 is connected to the substrate electrode, composite electrode, or both, of the MEMS device. A switching device 133, may also be connected in circuit with the source of electrical energy. In operation, when no electrostatic force is applied the distal portion and optionally the medial portion of the moveable composite are biased in an open position, as shown in FIG. 1. The application of electrical charge to the substrate electrode and moveable composite electrode creates an electrostatic force between them, attracting the moveable electrode to the substrate electrode as shown in FIG. 4. This causes the biased portion(s) to uncurl and conform to the surface of the microelectronic substrate, interconnecting the composite contact(s) and substrate contact(s) within each contact set.

In another embodiment, a source of electrical energy 135 can be connected to the substrate contact, composite contact, or both, of the MEMS device, in circuit with one or more devices, for example D1, shown as 137. As such, the source of electrical energy and one or more devices such as D1 can be selectively connected when the substrate contact(s) and composite contact(s) are electrically connected in response to the application of electrostatic forces. Preferably, an electrical load is connected to the substrate contacts, and the composite contact is used as a shorting bar for interconnecting the electrical load. Those skilled in the art will understand that sources of electrical energy, switching devices, and electrical devices or loads can be interconnected in various ways without departing from the present invention.

Depending on the location relative to the moveable distal portion, the contact set more proximate the fixed portion 70 will be connected first in time. Beginning with the MEMS device in the position shown in FIG. 1, the moveable composite is raised and the contacts are all open. As an electrostatic force is created between the substrate and moveable composite electrodes 20, 40, the moveable composite uncurls and contacts 26 and 27 will be connected before contacts 22 and 23. Once electrostatic force is no longer applied between the substrate and moveable electrodes, the distal and medial portions of the moveable composite can reassume the biased position. As the distal portion curls away, contacts 22 and 23 separate first, followed by contacts 26 and 27. The MEMS electrostatic switch and relay according to the present invention can switch voltages from 0.1 to 400 volts, while operating with electrostatic voltages in the range of 30 to 80 volts. Depending on the amount of electrical current switched and the device geometry, other switching voltages and operating voltages can be provided.

FIGS. 2–8 illustrate use of the multiple contact sets in parallel to minimize arcing by increasing the number of contact sets while also minimizing contact set resistance. Referring to FIGS. 2 and 3, and the detail shown in FIG. 6, substrate contacts 24A–24B, 25A–25B, and 26A–26B are connected in series, and are normally open when the flexible composite is biased to its raised position, as shown. Composite contacts 27, 28 and 29 are shorting contacts that electrically close the substrate contacts. This reduces arcing because each arc requires approximately 16 volts to occur, and multiple contacts will require a proportionally higher voltage to form an arc. The switch represented by FIGS. 2 and 6 comprises six sets of contacts and will require approximately 96 volts to arc. It is preferred that all of the second contact sets (i.e., 24–26) open essentially simultaneously, and this is more likely with a MEMS device. It is desirable to orient the contact sets parallel to the distal end of the moveable composite, as shown, in a direction that is generally parallel to the trough formed in the moveable composite as it curls upward.

The increased number of contacts can potentially increase the series resistance of the switch. To minimize this problem, yet maintain arc resistance, a single set of contacts 22A–22B is electrically and physically parallel to the multiple contact set, ensuring that the single set will open and close in sequence with the multiple set. As shown in FIGS. 2 and 6, the single set is closer to the distal end of the moveable composite. As the moveable composite uncurls from its raised position the multicontact sets 24, 25, 26 close first, quickly followed by contact set 22. This lowers the resistance of the entire switch, as represented by pads 34, 35 in FIG. 6. Reversing the sequence, as the moveable composite begins to curl, single contact set 22 opens first, followed by the multicontact set. This minimizes arcing while providing low contact resistance. The single contact shorting bar 124 shown in FIG. 5 can be used in the same sequential manner with the substrate contacts shown in FIG. 6.

The method for using the MEMS device comprises the step of selectively generating an electrostatic force between the substrate electrode and the electrode layer of the moveable composite. In addition, the method comprises the step of moving the moveable composite toward the microelectronic substrate. Further, the method comprises the step of electrically connecting the contacts of the first and second contact sets. After the electrically connecting step, the method can comprise the steps of discontinuing the electrostatic force, separating the moveable composite from the substrate, and sequentially disconnecting the contacts of the first and second contact sets.

The step of selectively generating an electrostatic force can comprise applying a voltage potential between the substrate electrode and the electrode layer of the moveable composite. The step of moving the moveable composite may comprise uncurling the moveable composite to lie generally parallel to the microelectronic substrate. Optionally, the step of electrically connecting can comprise electrically connecting the contacts on the moveable composite with contacts on the substrate. The step of separating the moveable composite from the substrate can comprise moving the moveable composite away from the substrate with a pivoting or curling displacement.

When the moveable composite has a fixed portion attached to the underlying substrate and a distal portion moveable with respect to the substrate electrode, the method can provide multiple steps as the first and second contact sets are disconnected. The step of separating the moveable composite from the substrate may comprise moving the moveable composite away from the substrate, with the distal end separating from the substrate prior to the remainder of the moveable composite separating from the substrate. This sequentially disconnecting step can comprise electrically disconnecting the contacts of the first set prior to electrically disconnecting the contacts of the second contact set. Optionally, the step of sequentially disconnecting may comprise disconnecting the contacts of the first and second contact sets generally simultaneously, wherein the second contact set comprises a plurality of contacts. However, the step of sequentially disconnecting the first and second contact sets can comprise disconnecting a single contact set within the first contact set. Further, the step of sequentially disconnecting can comprise disconnecting the contacts of the first contact set prior to disconnecting all contacts of the second contact set generally simultaneously. Alternatively, the step of separating the moveable composite from the substrate can comprise curling the moveable composite away from the substrate. In this case, the step of curling can further comprise the step of sequentially disconnecting the contacts of the first contact set prior to disconnecting the contacts of the second contact set.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limiting the scope of the present invention in any way.

That which is claimed:

1. A MEMS device driven by electrostatic forces, comprising:

a microelectronic substrate defining a planar surface;

a substrate electrode forming a layer on the surface of said substrate;

a moveable composite overlying said substrate electrode and having an electrode layer and a biasing layer, said moveable composite having a fixed portion attached to the underlying substrate, and a distal portion moveable with respect to said substrate electrode;

first and second contact sets, each contact set having at least one composite contact attached to said moveable composite; and an insulator electrically separating said substrate electrode from said moveable composite electrode layer;

whereby said contact sets are electrically connected when said moveable composite distal portion is attracted to said substrate.

2. A MEMS device according to claim 1 wherein one of said contact sets is closer to the distal portion of the moveable composite when said moveable composite assumes a biased position when electrostatic force is not applied thereto.

3. A MEMS device according to claim 1 wherein said distal portion of said moveable composite is positionally biased with respect to said microelectronic substrate.

4. A MEMS device according to claim 1 wherein at least one contact within the first contact set comprises a contact selected from the group consisting of a contact protruding from a respective surface, a contact generally flush with a respective surface, a contact having a generally smooth surface, and a contact having a generally rough surface.

5. A MEMS device according to claim 1 wherein at least one contact within the second contact set comprises a contact selected from the group consisting of a contact protruding from a respective surface, a contact generally flush with a respective surface, a contact having a generally smooth surface, and a contact having a generally rough surface.

6. A MEMS device according to claim 1 wherein said moveable composite substantially conforms to the surface of said microelectronic substrate when said moveable composite distal portion is attracted to said substrate.

7. A MEMS device according to claim 1 wherein the electrode layer and the biasing layer of said moveable composite are formed from one or more generally flexible materials.

8. A MEMS device according to claim 1 wherein said first contact set is more proximate said moveable composite distal portion than said second contact set.

9. A MEMS device according to claim 1 wherein said second contact set is more proximate said moveable composite fixed portion than said first contact set.

10. A MEMS device according to claim 1 wherein said first contact set is arranged to electrically disconnect prior to said second contact set disconnecting.

11. A MEMS device according to claim 1 wherein said second contact set comprises an array of at least two contact sets.

12. A MEMS device according to claim 1 wherein said second contact set is arranged to electrically disconnect all contacts therein generally simultaneously when said composite distal portion separates from said substrate.

13. A MEMS device according to claim 1 wherein said second contact set comprises a linear array of at least two contact sets.

14. A MEMS device according to claim 1 wherein said first contact set comprises a single contact set.

15. A MEMS device according to claim 1 wherein said first contact set is electrically connected in parallel with said second contact set.

16. A MEMS device according to claim 1 wherein the electrical resistance of said second contact set is greater than the electrical resistance of said first contact set.

17. A MEMS device according to claim 1 wherein each contact set has at least one substrate contact attached to said substrate.

18. A MEMS device according to claim 1 wherein at least one of said first and second contact sets comprises a pair of contacts attached to said substrate and a contact attached to said moveable composite to electrically connect said pair of contacts attached to said substrate.

19. A MEMS device according to claim 1 wherein said first and second contact sets share at least one common contact.

20. A MEMS device according to claim 18 wherein said common contact is attached to said moveable composite.

21. A MEMS device according to claim 1 wherein said contacts of said second contact set are electrically connected in series.

22. A MEMS device according to claim 1 wherein said contacts of said second contact set are electrically connected in parallel.

23. A MEMS device according to claim 1, wherein at least one of said contact sets is electrically isolated from said substrate electrode.

24. A MEMS device according to claim 1 wherein said biasing layer urges the composite distal portion to curl generally away from said substrate.

25. A MEMS device according to claim 1 wherein said composite biasing layer and electrode layer have different thermal coefficients of expansion, urging said moveable composite to curl.

26. A MEMS device according to claim 1 wherein said biasing layer comprises at least two polymer films, at least one of said polymer films having a different thermal coefficient of expansion than said electrode layer, urging said moveable composite to curl.

27. A MEMS device according to claim 1 wherein the distal portion of said moveable composite curls out of the plane defined by the upper surface of the substrate when no electrostatic force is created between said composite electrode and said moveable electrode.

28. A MEMS device according to claim 1, wherein at least one of said composite contacts is electrically isolated from said composite electrode.

29. A MEMS device according to claim 1, further comprising a source of electrical energy and a switchable device electrically connected to said first and second contact sets.

30. A method of using a MEMS device having a microelectronic substrate, a cantilevered composite having a fixed portion attached to the underlying substrate and a moveable distal portion, and first and second contact sets having contacts on said moveable composite and said substrate, the method comprising the steps of:

moving said distal portion of said cantilevered composite toward the substrate; and electrically connecting the contacts of the first and second contact sets.

31. The method of claim 30 further comprising after said electrically connecting step, the step of sequentially disconnecting the contacts of the first and second contact sets.

32. The method of claim 30 wherein said MEMS device further has an electrode layer in said cantilevered composite and a substrate electrode in said microelectronic substrate, the cantilevered composite moveable in response to an electrostatic force created between the substrate electrode and the composite electrode, and wherein the method further comprises the step of selectively generating an electrostatic force between the substrate electrode and the electrode layer of said cantilevered composite.

33. The method of claim 30 wherein the step of moving said cantilevered composite comprises uncurling said cantilevered composite to lie generally parallel to the substrate.

34. The method of claim 30 wherein the step of sequentially disconnecting the contacts comprises the step of separating the cantilevered composite from the substrate.

35. The method of claim 34 wherein the step of separating said cantilevered composite from the substrate comprises moving said cantilevered composite away from the substrate with a generally pivoting displacement.

36. The method of claim 34 wherein the step of separating said cantilevered composite from the substrate comprises moving said cantilevered composite away from the substrate with the distal end separating from the substrate prior to the remainder of said cantilevered composite separating therefrom.

37. The method of claim 31 wherein the step of sequentially disconnecting the contacts of the first and second contact sets comprises electrically disconnecting the contacts of the first contact set prior to electrically disconnecting the second contact set.

38. The method of claim 31 wherein the step of sequentially disconnecting the contacts of the first and second contact sets comprises disconnecting in a simultaneous mode a plurality of contacts in the second contact set.

39. The method of claim 31 wherein the step of sequentially disconnecting the contacts of the first and second contact sets comprises disconnecting a single contact pair in the first contact set.

40. The method of 31 wherein the step of sequentially disconnecting the contacts of the first and second contact sets comprises disconnecting the contacts of the first contact set prior to disconnecting in a simultaneous mode all contacts of the second set.

41. The method of claim 34 wherein the step of separating said cantilevered composite from the substrate comprises curling said cantilevered composite away from the substrate.

42. The method of claim 41 wherein the step of curling said cantilevered composite away from the substrate further comprises sequentially disconnecting the contacts of the first contact set prior to disconnecting the contacts of the second contact set.

43. A method of using a MEMS device having a microelectronic substrate, a cantilevered composite having a fixed portion attached to the underlying substrate and a moveable distal portion, and first and second contact sets having contacts on said cantilevered composite and substrate, the method comprising the steps of:

separating said cantilevered composite from the substrate at the distal portion; and sequentially disconnecting the contacts of the first and second contact sets.

* * * * *